166-274 SR
FIP7912 XR 4,022,278

United States Patent [19]
Allen

[11] 4,022,278
[45] May 10, 1977

[54] RECOVERY OF OIL BY A VERTICAL MISCIBLE FLOOD

[75] Inventor: Joseph C. Allen, Bellaire, Tex.
[73] Assignee: Texaco Inc., New York, N.Y.

[22] Filed: Nov. 5, 1975
[21] Appl. No.: 629,155
[52] U.S. Cl. ..... 166/269; 166/274
[51] Int. Cl.[2] ..... E21B 43/16; E21B 43/22
[58] Field of Search ..... 166/269, 268, 272, 258, 166/274

[56] References Cited

UNITED STATES PATENTS

| | | | |
|---|---|---|---|
| 2,897,894 | 8/1959 | Draper et al. | 166/272 |
| 3,360,045 | 12/1967 | Santourian | 166/269 |
| 3,371,711 | 3/1968 | Odeh et al. | 166/268 |
| 3,653,438 | 4/1972 | Wagner | 166/272 X |
| 3,845,821 | 11/1974 | Allen et al. | 166/269 |
| 3,850,243 | 11/1974 | Allen et al. | 166/274 X |
| 3,878,892 | 4/1975 | Allen et al. | 166/274 X |

*Primary Examiner*—Stephen J. Novosad
*Assistant Examiner*—George A. Suchfield
*Attorney, Agent, or Firm*—Thomas H. Whaley; Carl G. Ries; Charles L. Bauer

[57] ABSTRACT

A vertical miscible recovery process for the recovery of oil from an oil-bearing reservoir wherein a miscible slug or blanket of solvent is established at the crest of the oil column or at the gas-oil interface and thereafter is displaced downward by the injection of a drive agent such as natural gas or methane wherein the reservoir is produced simultaneously from near the bottom of the oil column and also near the top of the oil column thereby increasing the spreading rate of the solvent slug.

15 Claims, 1 Drawing Figure

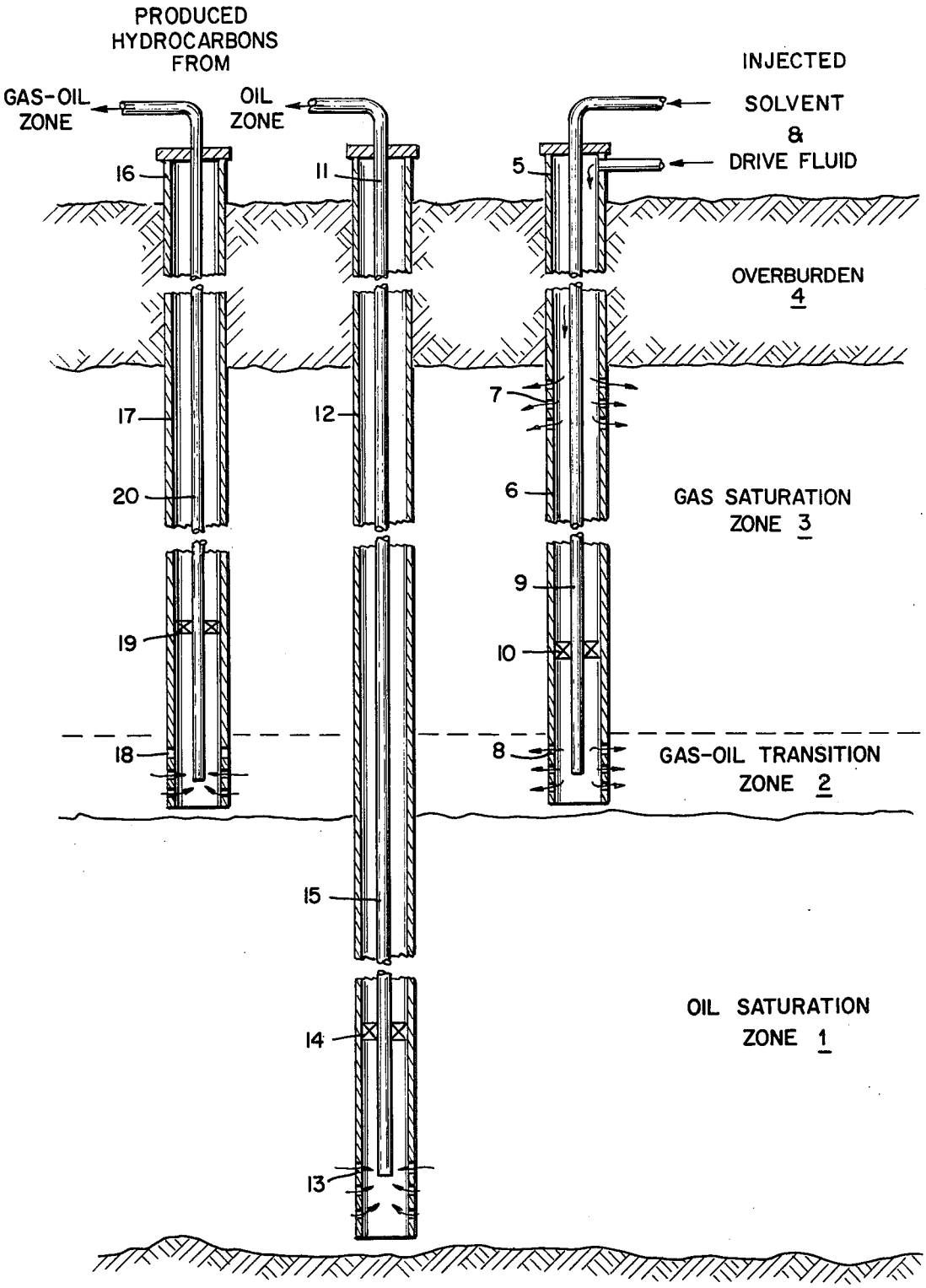
PRODUCED HYDROCARBONS FROM
GAS-OIL ZONE
OIL ZONE
INJECTED SOLVENT & DRIVE FLUID
16
11
5
OVERBURDEN 4
17
12
7
20
6
GAS SATURATION ZONE 3
9
19
10
18
8
GAS-OIL TRANSITION ZONE 2
15
OIL SATURATION ZONE 1
14
13

RECOVERY OF OIL BY A VERTICAL MISCIBLE FLOOD

FIELD OF THE INVENTION

This invention relates to a method for the recovery of oil by a vertical miscible flood wherein a miscible slug is formed at the crest of the oil column or the gas-oil interface, and which slug is driven downward through the reservoir by a drive agent wherein the oil is produced from the lower part of the reservoir, and simultaneously the reservoir is produced from the gas cap in a manner whereby improved coverage of the slug is accomplished and at an increased rate thereby minimizing dispersion and mixing of the slug into the oil column.

PRIOR ART

In the recovery of oil from a subterranean oil-bearing reservoir, one method that has been suggested for increasing oil recovery is that of miscible flooding wherein a solvent that is miscible with the reservoir oil is injected as a slug via an injection well, and thereafter a drive agent is injected to drive the solvent slug and the oil through the reservoir toward a production well from which the oil and solvent are recovered.

The process of miscible flooding is extremely effective in stripping and displacing the reservoir oil from the reservoir through which the solvent flows. This effectiveness is derived from the fact that a two-phase system within the reservoir and between the solvent and the reservoir oil is eliminated at the conditions of temperature and pressure of the reservoir whereby a miscible transition zone is formed which eliminates the retentive forces of capillarity and interfacial tension. These forces are significant factors in reducing the recovery efficiency of oil in conventional flooding operations where the dislacing agent and the reservoir oil exist as two phases in the reservoir.

In the usual miscile slug process, after the solvent slug has been injected in sufficient amounts to form the said transition zone, a drive agent is injected to drive the solvent slug and the reservoir oil through the reservoir. A second transition zone is formed at the trailing edge of the solvent slug between the solvent and the drive agent. Miscibility may exist between the solvent and the drive agent, dependent upon the reservoir conditions and the composition of the solvent and the fluid used as drive agent.

In steeply-dipping reservoirs or thick reservoirs having good vertical permeability, vertical displacement processes are known to improve the displacement efficiency resulting in increased recovery. Thick reservoirs may include reef reservoirs which herein mean oil-bearing formations whose matrix is a reef vis-a-vis a sandstone sediment or limestone deposit.

In a vertical slug displacement method, the solvent is injected at the crest of the oil column or at the gas-oil interface to form a slug or a "blanket" of the solvent between the gas cap and the oil column. Thereafter, a displacing fluid or drive agent is injected at or near the crest of the gas cap to displace the formed slug or blanket and the oil downward toward production wells that have communication with the lower horizons of the oil-bearing reservoir.

The compositions of the solvent used for the miscible slug is generally a light hydrocarbon such as propane of LPG, or a mixture of light hydrocarbons having from two to six carbon atoms in the molecule, although higher molecular weight hydrocarbons can be used under certain conditions. The solvent may also include in its composition methane or a lean gas, that is, a gas containing methane with minimum amounts of $C_2$–$C_6$ hydrocarbons. In determining the composition of the solvent to be used, the criterion is that the solvent be miscible with the reservoir oil at reservoir conditions of pressure and temperature.

The drive agent is generally a gaseous hydrocarbon such as natural gas or methane, that is capable of forming a miscible transition zone with the slug material. Prior art also teaches that the drive agent may be inert gases such as air, nitrogen or flue gases. The drive agent may also be water, in which case miscibility does not occur at the trailing edge of the solvent slug, in the situations where the solvent is a low molecular weight hydrocarbon or mixtures thereof.

The success of the process is greatly dependent upon maintaining the integrity and discreteness of the slug so that miscibility is retained during the flooding operation. At the same time, in order to attain optimum economic benefits, the size of the slug should be minimal.

One of the difficulties that has been realized in the miscible slug process is the disintegration of the slug with consequent loss of miscibility. In U.S. Pat. No. 3,845,821 there is taught that the undesirable mixing may be minimized thereby maintaiing the integrity of the slug by establishing the slug "in-situ" at the crest of the oil column or at the gas-oil interface by the separate and simultaneous injection of a stream of the light constituents and a stream of the heavy constituents comprising the miscible slug. The slug material is then followed by the injection of the drive agent to displace the slug and the reservoir oil downward through the reservoir.

In the present invention, the problems of establishing the slug or blanket that relate to the time required to lay down the slug as a blanket are overcome by establishing a pressure drop at the horizontal layer at the top of the oil column and at the same time producing fluids from the formed gap cap so as to minimize the dilution effect of the solvent slug. The idealized version of downward miscible blanket flooding contemplates the formation of a discrete, relatively thin layer of solvent which has spread completely across the top of the oil column from which oil recovery is sought, with the miscible slug or blanket being displaced downward in substantially piston-like manner by the subsequently injected drive agent. Oil production normally will be from a well or wells completed in the bottom of the oil-bearing reservoir. Initially only oil will be recovered, and after a substantial amount of time has elapsed a mixture of the previously injected solvent slug and oil will be recovered from the reservoir. Since the upper portion of the oil column has a reduced viscosity as a result of the presence of the miscible blanket therein, much more efficient displacement of oil from the reservoir is achieved than would be possible utilizing lean gas alone.

If the miscible blanket fails to spread over all of the top of the oil column or oil saturated zone, only a portion of the reservoir will be subjected to miscible blanket flooding, and the portion not covered by the spreading miscible blanket will be subjected only to downward displacement by lean gas. Gas displacement is relatively inefficient, so a portion of the reservoir over which the miscible blanket has not spread will experience much lower recovery efficiency than is achieved in the portion of the reservoir which has been covered by the miscible blanket. Accordingly, the anticipated high recovery efficiency of vertically downward miscible blanket flooding is achieved only if the injected solvent blanket spreads at a sufficiently high rate that it covers the top of the oil column completely. Thus, in U.S. Pat. No. 3,850,243 there is taught the improvement of spreading the slug of solvent material more rapidly by using the conventional solvent to which has been added a high density solvent such as carbon disulfide or certain halogenated hydrocarbons so as to more nearly match the density of the solvent to a value slightly less than the density of the reservoir oil. In a related patent, U.S. Pat. No. 3,878,892 there is taught the use of a high density solvent which is injected separately and simultaneously with the conventional solvent.

In view of the foregoing discussion, it can be appreciated that the total oil recovery efficiency will be reduced dramatically in applications of vertical downward moving miscible blanket flooding if complete spreading of the injected solvent blanket does not occur because of, for example, slow spreading rate. Accordingly, there is a substantial need for a method for improving the spreading rate of an injected solvent blanket over the top of the oil-saturated zone of the reservoir being subjected to miscible blanket flooding.

Still another problem is sometimes encountered in miscible blanket flooding. In application of this technique in formations containing appreciable quantities of asphaltic or bituminous materials, complete miscibility between the injected solvent and the reservoir oil may not be achieved. This is particularly true since the nature of the solvent is frequently influenced by the types of solvent materials available in the area. Mixtures of $C_1$ to $C_6$ aliphatic hydrocarbons, for example, sometimes are utilized as the miscible blanket, and saturated hydrocarbons such as these are not suitable solvents for asphaltic materials. Accordingly, there is also a substantial, unfulfilled need for an improved miscible blanket flooding technique which will achieve efficient recovery of high asphalt-content oil.

In the establishment of the solvent blanket on top of an oil column, gravity alone has been utilized for spreading the blanket on the oil column. Where the injection time is so long, dispersion of the blanket occurs before the slug reaches the periphery of the oil column trap.

In addition to this another difficulty lies in the dilution effect by the mixing of the slug with the residual oil that exists in the gas column. As the solvent in the slug invades the gas cap in a horizontal manner it displaces the gas phase preferentially to the oil because of the high relative permeability and the low viscosity of the gas.

The efficiency of the displacement varies directly with the pressure. In order to maintain the pressure at a high level the gas is injected into the crest of the reservoir via other wells while the solvent is injected at the top of the oil column. The volume of gas cap invaded is high due to the high vertical build-up of the slug around the injection well that is necessary to impose adequate driving potential to invade horizontally the entire top of the oil column. The time of arrival of the slug at the periphery is delayed and a larger volume of gas cap is invaded which adds to the dilution of the slug by the residual oil.

In order to overcome these difficulties and to minimize the amount of slug required I have found that simultaneous injection of the solvent slug into the top of the oil column together with the production of the gas cap near the top of the oil column will improve the laying down of the blanket of solvent and maintain the integrity of the slug.

BRIEF DESCRIPTION OF THE FIGURE

The accompanying FIGURE is an illustrative embodiment of the invention showing a solvent injection well and two production wells.

DESCRIPTION OF THE INVENTION

This invention may be applied to steeply-dipping reservoirs or thick reservoirs having good vertical permeability. In the practice of this invention, the reservoir is penetrated by at least one crestal injection well into the upper horizon of the oil saturation zone and at least two production wells one of which penetrates the lower horizon of the oil saturation zone of the reservoir and the second of which penetrates the upper horizon of the oil saturation zone, and which well bears a spaced horizontal relation to the solvent injection well.

In its broadest aspect, this invention provides for a solvent injection well that penetrates the top several feet of the oil column. In reservoirs that do not initially contain a gap cap, the solvent injection well or wells are completed in or near the crest penetrating several feet into the oil column or oil-bearing reservoir adjacent the over-burden stratum. In reservoirs that contain a gas cap, either present initially or formed by production and gravity drainage, the solvent injection well or wells penetrate the reservoir at least to the depth of the gas-oil transition region. This region is a transition region between the upper gas saturation zone and the lower oil saturation zone in which the fluid saturation changes from one of predominantly gas saturation to one of oil saturation. This transition region is often referred to as the gas-oil interface.

In one embodiment, the injection well is completed so as to provide for the injection of the slug material and the drive agent by suitable completion techniques known in the art.

A preferred method of operation of the invention is illustrated in the accompanying FIGURE which depicts the situation where the reservoir has an oil saturation zone 1 containing liquid hydrocarbons, a gas saturation zone 3 and is overlain by overburden 4. There is also shown a gas-oil transition zone 2, which may be referred to as the gas-oil interface and which is the horizon where the solvent blanket will be established. A dual-completed injection well 5 is depicted that traverses the gas saturation zone 3 of the oil-bearing reservoir and is completed to the depth of the gas-oil interface 2, above the oil-saturation zone 1. A primary casing 6, traversing the gas saturation zone 3 to at least the uppermost region of the oil saturation zone is cemented in place and is perforated in two intervals as shown by perforations 7 and 8, thereby forming a first and second set of perforations. Thereafter, a tubing 9 is inserted into the casing to a depth adjacent the perforations 8. A packer 10 is then set in the annulus formed by the tubing and the casing, positioned intermediate between the two sets of perforations, that is above perforations 8, and below perforations 7. The lower end of the tubing 9 is open to provide communication with the formation via the perforations 8.

While the FIGURE shows the use of a single well with dual completion, two injection wells may be used, one penetrating at least to the gas-oil transition zone and the second penentrating the gas cap so as to provide means for the injection of the solvent slug and the drive agent separately. These wells would be completed by conventional means well-known in the art.

Referring again to the accompanying FIGURE a production well 11 is provided that traverses the reservoir to at least the bottom of the oil saturation zone 1. The well is completed with casing 12, perforations 13, packer 14 and tubing means 15. Communication with the oil saturation zone 1 via the perforations 13 is provided whereby the oil is produced from the reservoir. A pump, not shown, may be located at the bottom of the tubing string.

A second production well 16 is also provided that penetrates to the horizon of the gas-oil transition zone or the gas-oil interface and the well is completed with casing 17, which is provided with perforations 18 for communication with the gas-oil transition zone 2. The well may be completed in the conventional manner with packer 19 and tubing string means 20 having communication with the gas-oil transition zone.

It may be desirable in some instances to utilize a dual-completed production well. The well would be completed in a manner similar to that described for the dual-completed injection well, with the well being perforated at the bottom of the oil saturation zone and at the gas-oil transition zone, and with a packer set in the annulus.

While it is taught in the prior art that the rate of spreading is determined by the viscosity of the injected solvent and the difference in density between the solvent and the gas in the gas saturation zone, in the present invention the additional factor of pressure drop is considered. Thus the production well 16, bears a spaced relationship to injection well 5 that can be determined by the desired pressure drop across the horizon at which depth both wells have been completed. For example, at reservoir conditions of 3000 psi for a desired pressure drop of 100 psi the second production well would be about 2000 feet from the injection well.

In operation the solvent is injected via the tubing 9 of injection well 5 and perforations 8 into the gas-oil transition zone. Simultaneously with the injection of solvent, well 16 is produced in a manner to maintain a pressure drop across the horizon to increase the spreading rate of the solvent, thereby establishing the solvent blanket more rapidly. Once the solvent blanket has been established across the oil saturation column, well 16 may be shut in. The well 16 may later, under certain reservoir conditions, be utilized as an injection well for the drive fluid as the solvent blanket is displaced downward.

In the application of this invention, the reservoir may be repressured, if required to attain miscibility by the injection of other fluids to establish at least saturated reservoir conditions prior to or during the injection of the solvent slug. Fluids that may be used for repressuring include methane, natural gas, carbon dioxide, nitrogen, air, water and mixtures thereof.

It is within the scope of the practice of this invention to include miscible floods that are termed "instant miscible" floods, and "conditional miscible" floods. In the former type, miscibility occurs on contact of the injected solvent fluid with the reservoir oil. In the latter type, miscibility is attained within the reservoir either by the vaporizing of the lighter constituents of the oil into the solvent fluid or by the adsorption of the heavier constituents of the solvent fluid into the oil. The composition of the solvent for the type of miscible flood desired may be determined by laboratory tests such as slim tube tests which involve techniques well-known in the art.

The compositions of the solvent slug may be a light hydrocarbon such as propane or LPG, or a mixture of light hydrocarbons having from two to six carbon atoms in the molecule, although higher molecular weight hydrocarbons can be used under certain conditions. The solvent may also include in its composition methane whereby the solvent is a lean gas, that is, a gas containing methane with minimum amounts of $C_2$ to $C_6$ hydrocarbons said lean gas being miscible with the reservoir oil at reservoir conditions of temperature and pressure.

The solvent is injected in amounts sufficient to form a slug or blanket at the top of the oil column or at the gas-oil transition zone.

After the solvent blanket has been established, the drive agent is injected to displace the blanket downward through the reservoir, thereby displacing the oil ahead of the solvent toward the production wells from which the oil is recovered.

The drive agent or driving fluid employed may be any gaseous material that is gaseous at reservoir conditions. Additionally, the drive agent may be miscible with the solvent slug. The preferred drive agent is a relatively inexpensive gas, such as a gas containing substantially methane or natural gas or flue gas, or a gas from a gas-processing facility. Other gases that may be employed include ethane, carbon dioxide, nitrogen, air and mixtures thereof. The drive agent is injected in an amount sufficient to displace the solvent slug or blanket through the reservoir thereby displacing the reservoir oil ahead of it and also recovering the solvent. The drive agent is injected at a rate so that the preferred rate of movement is from about 0.3 to 10.0 feet per day.

In summary, in accordance with the practice of this invention a vertical miscible flood is carried out in the following manner. There is introduced into the reservoir at the top of the oil column or oil saturation zone, a solvent slug or blanket that is miscible with the oil, and separately and simultaneously production occurs from the same horizon so as to increase the spreading rate of the slug. Thereafter, or simultaneously therewith, a drive agent or drive fluid is injected to displace the solvent and the reservoir oil downward toward a production well completed in the lower horizon of the oil saturation zone from which the reservoir oil is produced. The previously injected blanket of solvent will retain its discreteness, spread over the entire oil column, and be continually displaced downward through the oil column by the gas being injected above. After the solvent blanket is produced with residual reservoir oil dissolved in it, the solvent may be recovered for use in another field project. Eventually when gas production begins, the production wells may be recompleted as gas production wells and gas production will be taken from the formation until pressure is depleted. The gas may be reused in another field or sold as fuel.

Although my invention has been described in terms of several embodiments, variations thereon will be apparent to persons skilled in the arts without departing from the spirit and scope of the invention.

I claim:

1. A method for the recovery of oil from a subterranean oil-bearing reservoir having an oil saturation zone, a gas-oil transition zone, and a gas saturation zone wherein a slug or blanket of solvent miscible with said oil is driven downwardly through said reservoir by a drive agent, thereby displacing said oil downwardly through said reservoir, comprising the steps of:

a. providing a first injection means extending into said reservoir adjacent said gas-oil transition zone for injection of said solvent into said reservoir,
b. providing a second injection means extending into said reservoir adjacent said gas saturation zone for injecting said drive agent into said reservoir,
c. providing a first production means in spaced relation to said first injection means and adjacent said gas-oil transition zone,
d. providing a second production means extending into said reservoir and adjacent the lower horizon of said oil saturation zone,
e. injecting via said first injection means a solvent in amounts sufficient to establish said blanket of said solvent in the vicinity of said gas-oil transition zone,
f. simultaneous therewith producing fluids via said first production means, from said gas-oil transition zone thereby creating a pressure gradient at said gas-oil transition zone during the establishment of said solvent blanket at said gas-oil transition zone,
g. shutting in said first production means after said solvent blanket has been established,
h. injecting via said second injection means a drive agent to displace said solvent blanket and said reservoir oil downwardly through said reservoir,
i. producing said oil via said second production means.

2. The method of claim 1 wherein said first and second injection means comprise a well completed by setting a casing to at least said gas-oil transition zone said casing being perforated in two intervals thereby forming a set of first perforations to a depth adjacent said gas-oil transition zone and a set of second perforations adjacent the upper portion of said gas saturation zone, running a tubing into said casing to a depth of said gas-oil transition zone and setting a packer in the annulus formed by said casing and said tubing and intermediate between said two sets of perforations.

3. The method of claim 1 wherein said solvent is composed of hydrocarbons comprising light hydrocarbons having from 2 to 6 carbon atoms in the molecule and mixtures thereof.

4. The method of claim 3 wherein said solvent contains methane.

5. The method of claim 1 wherein said drive agent is selected from the group consisting of methane, natural gas, flue gas, ethane, carbon dioxide, nitrogen, air and mixtures thereof.

6. The method of claim 1 wherein said drive agent is miscible with said slug at reservoir conditions of pressure and temperature.

7. The method of claim 1 wherein said reservoir is repressured to substantially its saturation pressure by the injection of a fluid selected from the group comprising methane, natural gas, carbon dioxide, nitrogen, air, water and mixtures thereof.

8. The method of claim 1 wherein said first production means is utilized as an injection means for said drive agent.

9. The method of claim 1 wherein a third injection means is provided extending into said reservoir adjacent said uppermost region of said oil-bearing reservoir and injecting said drive agent via said third injection means.

10. A vertical downward miscible flooding technique for recovering oil from a subterranean oil-bearing reservoir, said reservoir having an oil saturation zone and a gas saturation zone wherein a blanket of solvent miscible with said oil is driven downwardly through said reservoir by a drive agent thereby displacing said oil downwardly through said reservoir comprising the steps of:

a. providing a first injection well penetrating said reservoir to the top of said oil saturation zone,
b. providing a second injection well extending to the top of said gas saturation zone,
c. providing a first production well extending to the top of said oil saturation zone,
d. providing a second production well extending to the bottom of said oil saturation zone,
e. injecting said solvent via said first injection well and simultaneously producing fluid via said first production well, to establish said blanket of miscible solvent,
f. shutting in said first production well after said solvent blanket has been established,
g. injecting said drive agent via said second injection well to displace said blanket and said oil downwardly through said reservoir,
h. producing said oil via said second production means.

11. The method of claim 10 wherein said solvent is composed of hydrocarbons comprising light hydrocarbons having from 2 to 6 carbon atoms in the molecule and mixtures thereof.

12. The method of claim 11 wherein said solvent contains methane.

13. The method of claim 10 wherein said drive agent is selected from the group consisting of methane, natural gas, flue gas, ethane, carbon dioxide, nitrogen, air and mixtures thereof.

14. The method of claim 10 wherein said drive agent is miscible with said slug at reservoir conditions of pressure and temperature.

15. The method of claim 10 wherein said reservoir is repressured to substantially its saturation pressure by the injection of a fluid selected from the group comprising methane, natural gas, carbon dioxide, nitrogen, air, water and mixtures thereof.

* * * * *